US011384717B2

(12) United States Patent
Tomas Herrero et al.

(10) Patent No.: US 11,384,717 B2
(45) Date of Patent: Jul. 12, 2022

(54) HEAT EXCHANGER FOR GASES, IN PARTICULAR ENGINE EXHAUST GASES

(71) Applicant: Valeo Termico, S.A., Saragossa (ES)

(72) Inventors: Eva Tomas Herrero, Saragossa (ES); Jorge Arroyo Villanueva, Saragossa (ES); Raul Romero Perez, Saragossa (ES); Carlos Rodrigo Marco, Saragossa (ES)

(73) Assignee: Valeo Termico, S.A., Saragossa (ES)

( * ) Notice: Subject to any disclaimer, the term of this patent is extended or adjusted under 35 U.S.C. 154(b) by 0 days.

(21) Appl. No.: 17/311,130

(22) PCT Filed: Dec. 5, 2019

(86) PCT No.: PCT/ES2019/070830
§ 371 (c)(1),
(2) Date: Jun. 4, 2021

(87) PCT Pub. No.: WO2020/115349
PCT Pub. Date: Jun. 11, 2020

(65) Prior Publication Data

US 2021/0381472 A1 Dec. 9, 2021

(30) Foreign Application Priority Data

Dec. 5, 2018 (ES) ..... ES201831184

(51) Int. Cl.
*F02M 26/32* (2016.01)

(52) U.S. Cl.
CPC ..... *F02M 26/32* (2016.02)

(58) Field of Classification Search
CPC ..... F02M 26/32; F02M 26/28
(Continued)

(56) References Cited

U.S. PATENT DOCUMENTS 6,289,977 B1 * 9/2001 Claudel ..... B23K 26/10 165/157
8,118,082 B2 * 2/2012 Beck ..... F01N 3/043 165/103
(Continued)

FOREIGN PATENT DOCUMENTS

EP 1376042 A2 1/2004
EP 1898464 A1 3/2008
(Continued)

OTHER PUBLICATIONS

International Search Report and Written Opinion in corresponding International Application No. PCT/ES2019/070830, dated Mar. 12, 2020 (11 pages).

*Primary Examiner* — Phutthiwat Wongwian
*Assistant Examiner* — Arnold Castro
(74) *Attorney, Agent, or Firm* — Osha Bergman Watanabe & Burton LLP

(57) ABSTRACT

The present invention relates to a heat exchanger for gases, in particular for the exhaust gases of an engine, which includes a plurality of gas circulation conduits and a casing for the exchange of heat between said gases and a coolant fluid that surrounds the gas circulation conduits housed inside the casing, wherein baffles are used to configure the passage of the coolant fluid between said gas circulation conduits, having at least one inlet baffle that directs the flow of coolant to the part and thus improving the operating conditions of the exchanger and making same more efficient.

15 Claims, 4 Drawing Sheets

(58) Field of Classification Search
USPC ..... 123/568.12; 165/157, 167
See application file for complete search history.

(56) References Cited

U.S. PATENT DOCUMENTS

| | | | | |
|---|---|---|---|---|
| 10,415,515 | B2 * | 9/2019 | Grill | F28D 7/1692 |
| 2005/0189097 | A1 | 9/2005 | Fowser et al. | |
| 2006/0174611 | A1 * | 8/2006 | Dilley | F28D 9/005 60/320 |
| 2010/0319889 | A1 * | 12/2010 | Ikeda | F28F 1/025 165/157 |
| 2013/0105128 | A1 * | 5/2013 | Vanderwees | F28D 9/005 165/165 |
| 2013/0327499 | A1 * | 12/2013 | Goncalves | F02M 26/32 165/85 |
| 2015/0059716 | A1 * | 3/2015 | Na | F02M 26/32 123/568.12 |
| 2015/0292804 | A1 * | 10/2015 | Hermida Dominguez | F28F 21/084 165/167 |
| 2015/0362264 | A1 * | 12/2015 | Grande Fernandez | F28F 9/005 165/159 |
| 2017/0058842 | A1 * | 3/2017 | Grande Fernandez | F28D 7/1684 |
| 2021/0164421 | A1 * | 6/2021 | Carrera Garcia | F28F 9/005 |

FOREIGN PATENT DOCUMENTS

| | | | |
|---|---|---|---|
| WO | 2013059941 | A1 | 5/2013 |
| WO | 2015141884 | A1 | 9/2015 |

* cited by examiner

HEAT EXCHANGER FOR GASES, IN PARTICULAR ENGINE EXHAUST GASES

The present invention relates to a heat exchanger for gases, in particular for the exhaust gases of an engine, which includes a plurality of gas circulation conduits and a casing for the exchange of heat between said gases and a coolant fluid that surrounds the gas circulation conduits housed inside the casing. In particular, the present invention relates to a heat exchanger that includes coolant fluid distribution baffles.

BACKGROUND OF THE INVENTION

Heat exchangers for engine exhaust gases which are to be recirculated and which have to lower their temperature before doing so work on the principle of the exchange of heat between the exhaust gases and a coolant fluid, so as to cool these gases before entering the engine again. Currently, heat exchangers of this kind are widely used for diesel applications, in order to reduce emissions, as well as in gasoline applications in order to reduce fuel consumption.

Until now, the configuration of the present type of heat exchangers for engine exhaust gases corresponds to a heat exchanger that includes a heat-exchange casing, generally made of stainless steel or aluminum, inside which a bundle of parallel conduits is arranged for the passage of gases, the coolant circulating inside the casing, between the gas conduits and outside them.

The entry and exit of coolant fluid inside the heat-exchange casing is carried out via inlet and outlet connections for coolant fluid that are both coupled to the casing in a leak-tight manner. The circulation of the coolant fluid inside must achieve adequate heat-exchange efficiency with the gas circuit, trying to avoid the appearance of areas with little circulation of the coolant fluid. To do this, it is customary to use protrusions on the plates of the gas conduits, which interfere with the area for passage of the coolant fluid in order to disrupt the flow of coolant fluid, said protrusions defining a plurality of adjacent fluid passageways, formed by said protrusions being in contact between two adjoining plates.

Heat exchangers of this type receive gases at temperatures of up to 850° C., which, in the process of heat exchange with the coolant fluid, with the existing coolant fluid passage configurations, entail a real risk of excessive heating of the coolant fluid that can lead to evaporation thereof due to the high thermal shock that occurs, since it does not have an efficient distribution and flow rate.

DESCRIPTION OF THE INVENTION

The objective of the present invention is to provide a heat exchanger for gases, in particular for engine exhaust gases, including an arrangement of coolant distribution baffles, which manages to solve the aforementioned drawbacks and exhibits other advantages that will be described below.

In accordance with this objective, according to a first aspect, the present invention provides a heat exchanger for gases, in particular for engine exhaust gases, comprising a heat-exchanger casing that delimits a circuit for the circulation of a coolant fluid, a plurality of gas conduits installed within said heat-exchanger casing, a gas inlet for gas circulation inside said conduits, and an inlet for the coolant fluid inside the casing.

The heat exchanger is characterized in that the gas conduits each comprise an arrangement of baffles for distributing coolant on at least one of the outer faces thereof, said arrangement of baffles for distributing coolant comprising at least one inlet baffle located near the coolant inlet. This inlet baffle is characterized in that it comprises a first portion and a second portion arranged in a substantially orthogonal position so as to guide the coolant inlet toward the gas inlet of the exchanger.

This configuration of the inlet baffle allows the flow of coolant that enters the circuit to be distributed or guided toward the gas inlet of the gas conduits of the exchanger, which is where a greater thermal shock occurs, thus achieving a better distribution and higher speed and avoiding the risks of evaporation due to lack of coolant or low speed of coolant flow in these areas.

According to one possible embodiment of the invention, the first portion of the inlet baffle is substantially perpendicular to a plane defined by the first edge or side of the gas conduits, without obstructing the coolant inlet, and the second portion is substantially parallel to the same plane defined by said first edge or side of the gas conduits, said second portion being arranged facing the gas inlet.

In particular, the two portions of the inlet baffle of the present invention are arranged orthogonally from a first edge of the gas conduits, without obstructing the coolant inlet, so as to guide the coolant inlet, toward the area of the coolant circuit that is closer to the gas inlet of the exchanger, advantageously forming in each conduit a distributor/guide for the entry of the coolant into the exchanger casing.

Said first edge of the gas conduits corresponds to the lateral edge or side of the gas conduit adjoining the coolant inlet, from where the inlet baffle starts, whether in contact with said edge or not.

This configuration is preferably implemented by means of an inlet baffle, wherein the first and second portions of the inlet baffle both form a single "L"-shaped piece. These orthogonal configurations achieve an effective distribution of the coolant inlet by advantageously redirecting it, as indicated, toward the gas inlet area.

In one possible alternative embodiment, the inlet baffle comprises a first and second portion which are joined so as to form an arc-shaped baffle or are arranged in two sections that are inclined with respect to the first edge of the gas conduits. Optionally, the inlet baffle can include at least one transition portion between the first portion and the second portion.

According to one embodiment of the invention, an end of the second portion of the inlet baffle, which is the end not adjoining the first portion of the baffle, is located facing the gas inlet, preferably at a distance of between 6 and 12 mm from the end of the gas conduits that is closest to the gas inlet of the exchanger.

Advantageously, said end of the second portion of the inlet baffle, which is the end not adjoining the first portion, is located at a distance of between 3.5 and 8 mm from the side of the gas conduits that is located close to the coolant inlet.

Multiple computer simulations determine that these distances position the inlet baffle and especially the end of said baffle in an advantageous manner.

Advantageously, the second portion of the inlet baffle has a length that is at least equal to or greater than the width of the opening of the coolant inlet. In this way it is possible to redirect all of the coolant entering the circuit toward the gas inlet area, without a significant portion being directed toward the outlet for the coolant.

Preferably, the arrangement of coolant distribution baffles comprises, in addition to the inlet baffle, a first plurality of baffles that define at least one first group of transversely arranged baffles in a staggered configuration, such that each baffle of said first group of transversely arranged baffles is situated at a different distance from the end of the gas conduits closest to the gas inlet of the exchanger.

By means of this first group of transversely arranged, staggered baffles, it is possible to standardize the distribution of coolant across the width of the exchanger, continuing the improvement in distribution achieved with the inlet baffle and improving the speed of passage of the coolant fluid, by virtue of the longitudinal guidance of coolant fluid between said baffles.

According to one embodiment, a longitudinal axis of each baffle of the first group of transversely arranged baffles is arranged so as to form an angle A1 of inclination of between 0° and 60° with respect to a longitudinal axis E2 of the gas conduits.

These angles can be set at different values taking into account different parameters for the composition of the exchanger, such that, depending on the width, length and other characteristic dimensions of the gas conduits, different optimum angles and distances associated with said baffles can be used.

According to a preferred embodiment of the invention, the arrangement of baffles comprises, in addition to the inlet baffle, a second plurality of baffles comprising one or more transversely distributed groups of staggered baffles, arranged on a first side of the central longitudinal axis E2 of the gas conduits, and a third plurality of baffles comprising one or more transversely distributed groups of staggered baffles, arranged on the second side of the central longitudinal axis E2 of the gas conduits, with one or more groups of the second and third plurality of baffles being arranged at different distances from the end of the gas conduits.

Preferably, the longitudinal axis of each of the baffles of the second and third plurality of baffles is arranged so as to form an angle A2 of inclination of between 0° and 60° with respect to a longitudinal axis E2 of the gas conduits. It is usually considered that said range can be executed both positively and negatively with respect to said central axis.

Advantageously, the baffles have a height that is at most substantially equal to half the separation distance between gas conduits, among which said baffles are located, without coming into contact with baffles located in an opposite adjoining conduit.

This configuration allows the baffles of two adjoining conduits, on their opposite faces, not to touch, allowing the passage of coolant between them and thus also achieving a greater speed of passage of the coolant fluid.

Alternatively, the opposing baffles may come into contact with each other and thus without describing a passage of coolant fluid between the opposing baffles of adjoining gas conduits.

This alternative configuration makes it possible to have a more effective arrangement of the passages created by the baffles, for thermal shock conditions that are not considered so harsh, and when the results of the simulations so require.

In one possible embodiment, each of the gas conduits is formed by a pair of plates or by a tube, and the inlet baffle and the first, second and third plurality of baffles are obtained by stamping or embossing on at least one external face of the gas conduit.

Optionally, some of the staggered baffles belonging to a group on one side or the other of the longitudinal central axis of the gas conduit can overlap with those on the other side. Preferably, the above features apply to a heat exchanger which is a shell-and-tube type heat exchanger.

According to a second aspect, the present invention proposes a process comprising a step of stamping or embossing the arrangement of coolant distribution baffles in a gas conduit, said stamping or embossing being carried out on at least one plate or on at least one tube, forming part of said gas conduit.

BRIEF DESCRIPTION OF THE FIGURES

For a better understanding of what has been explained, drawings are attached in which, schematically and only as a non-limiting example, a practical case of embodiment is shown.

DESCRIPTION OF A PREFERRED EMBODIMENT

Figure 1:
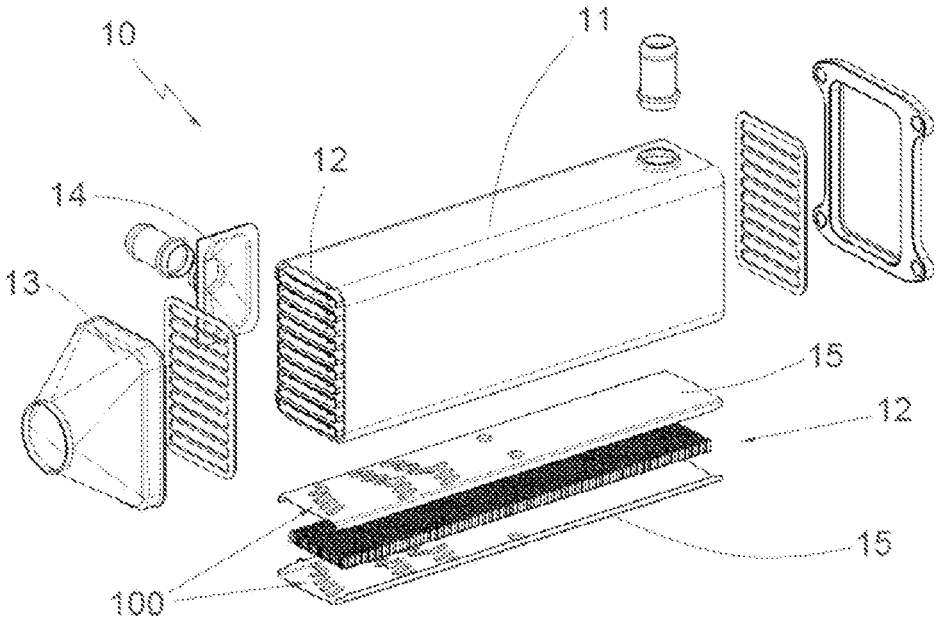
FIG. 1 is an exploded view of the heat exchanger for gases, in which the internal configuration thereof and the gas and coolant inlets can be seen.
Figure 2:
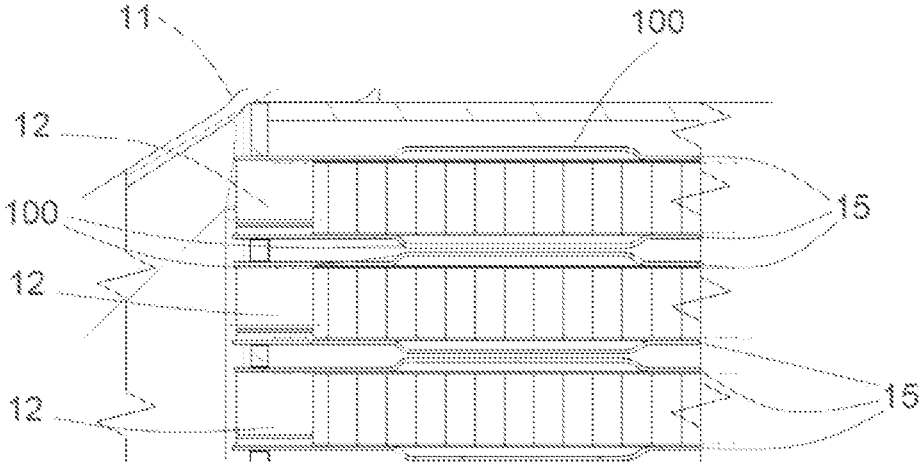
FIG. 2 is a partial detail view of a cross section of a number of gas conduits showing the gas passage conduits and the spacing between adjoining baffles of two gas conduits.
Figure 3:
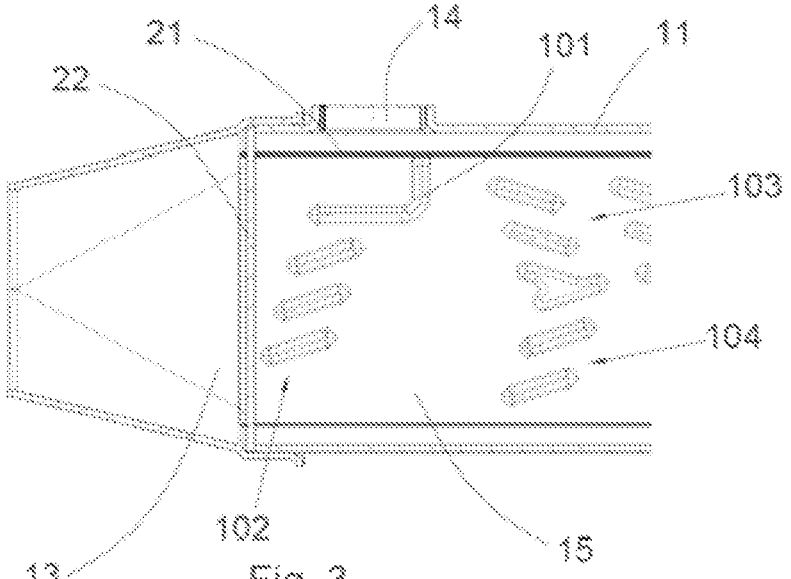
FIG. 3 is a partial view of the inside of the refrigeration circuit in the area close to the gas and coolant inlet area, showing both inlet connections.

In the following text, various embodiments of the heat exchanger for combustion gases with coolant fluid distribution baffles of the present invention are described, with reference to the figures indicated above.

In one embodiment of the invention, the heat exchanger (10) for engine gases for subsequent recirculation, commonly known as EGR, comprises a casing (11) that delimits a circuit for the circulation of a coolant fluid, laterally enveloping a plurality of gas conduits (12), formed by a pair of plates, which pass through said coolant circuit, with a gas inlet (13) for the circulation of gas through said conduits (12) until it exits at the other end. The coolant circuit formed in the volume between the casing (10) and the gas conduits (12) has a coolant inlet (14).

The combustion gases to be cooled, originating from the engine, are carried inside the gas conduits (12), with each one of said gas conduits (12) including an arrangement (100) of baffles for distribution of coolant, on both outer faces (15), between which the coolant fluid circulates.

At the coolant fluid inlet (14) in the casing (11), in each space between gas conduits (12) that creates the refrigeration circuit, an inlet baffle (101) is located. In each conduit, said inlet baffle (101) creates a distributor/guide (18) for the entry of the coolant into the casing (11) of the exchanger (10).

Figure 4:
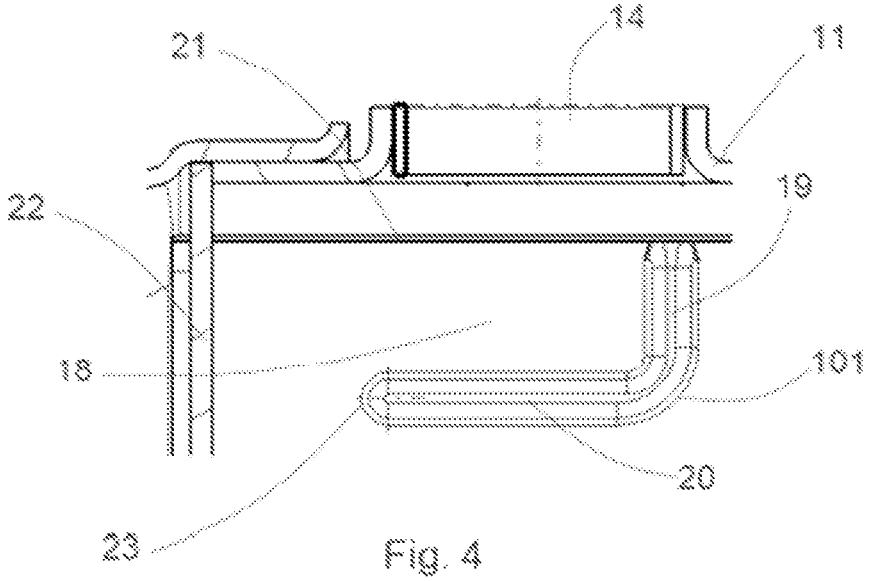
FIG. 4 is a partial view of a gas conduit from the outer face, where the detail of the inlet baffle can be seen.
Figure 5:
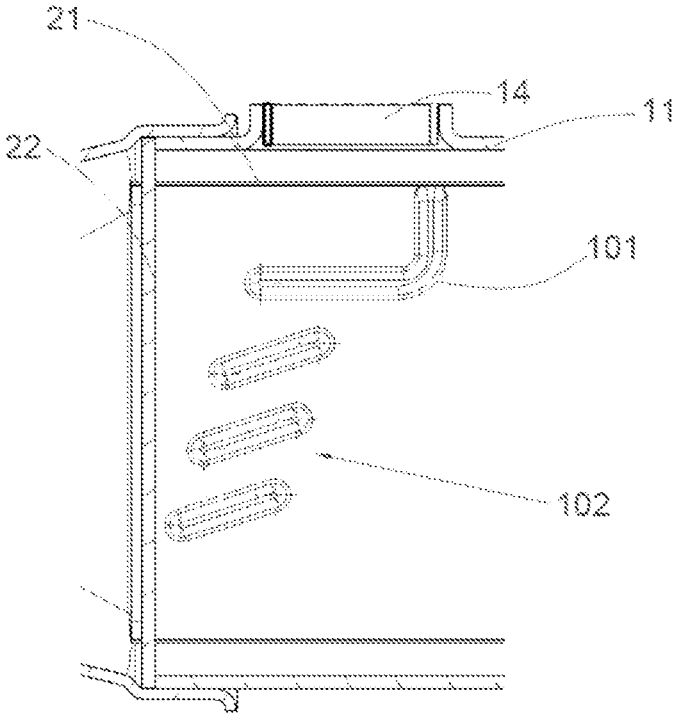
FIG. 5 is a partial view of a gas conduit from the outer face, where the detail of the inlet baffle and the first plurality of baffles that define a first group of transversely arranged staggered baffles can be seen.
Figure 6:
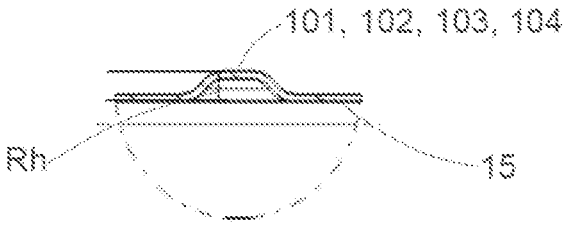
FIG. 6 is a partial sectional view of any baffle which has been formed by stamping the very plate that forms the conduit.
Figure 7:
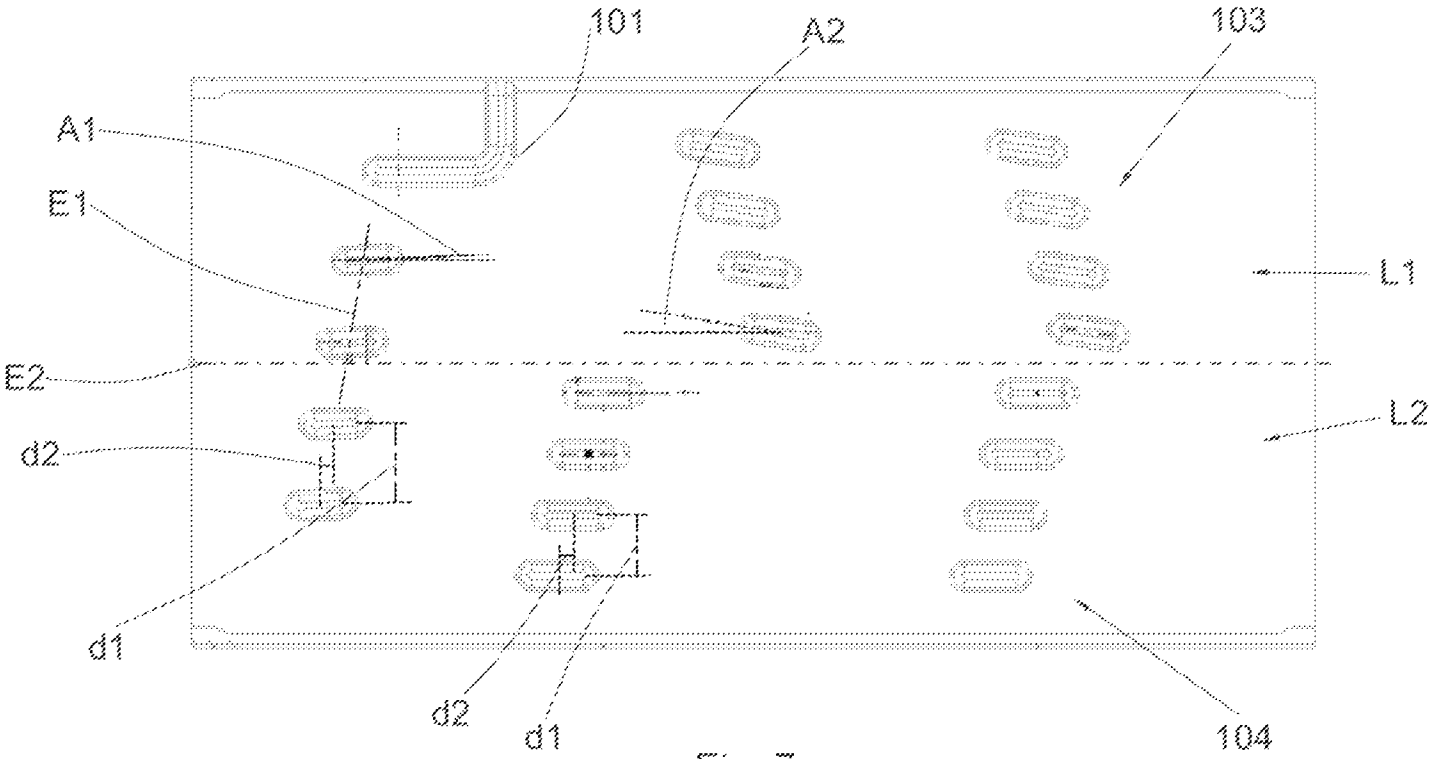
FIG. 7 is a partial view of a gas conduit from the outer face, where the detail of the inlet baffle and the first, second and third plurality of staggered baffles that define the corresponding transversely arranged groups of baffles can be seen.

In the present embodiment, the inlet baffle (101) is preferably implemented by stamping, on each outer face (15) of each gas conduit (12), a relief that protrudes from the surface thereof toward the space created between gas conduits (12) inside the exchanger. The inlet baffle (101) is designed in an "L" shape, with a first portion (19) and a second portion (20) arranged starting from a first edge (21) or side of the gas conduits (12) (see FIG. 4). This inlet baffle (101) has been arranged so that, without obstructing the coolant inlet (14) itself, it guides the flow of coolant fluid toward the area of the circuit closest to the gas inlet (13), preventing the coolant fluid from being directed directly to more advanced areas of the gas conduits (12) of the exchanger (10).

The shape of the inlet baffle (101) can be substantially different from the "L" shape. However, the first portion (19) of the inlet baffle (101) will preferably be substantially perpendicular to a plane defined by a first edge (21) or side of the gas conduits (12) and the second portion (20) will be substantially parallel to the same plane defined by said first edge (21) of the gas conduits (12).

The dimensions of the inlet baffle (101) depend on the position of the coolant inlet (14) in the exchanger. However, in order to create an efficient distributor for guiding the coolant to the desired area, as seen in the figures, the end (23) of the second portion (20) of the inlet baffle (101), that is to say, the end not adjoining the first portion (19), is preferably located at a distance of between 6 and 12 mm from the end or second edge (22) of the gas conduits (12) that is closest to the gas inlet (13) of the exchanger. This end (23) of the second portion (20) is also located at a distance of between 3.5 and 8 mm from the first edge (21) or side of the gas conduits (12).

In the present embodiment, this configuration is implemented by means of a single-piece inlet baffle (101); that is to say, the two portions (19 and 20) are made continuously, although in alternative embodiments these portions may be adjoining and not joined, or may even have an intermediate connecting portion between the two.

The arrangement (100) of baffles for distribution of coolant in the gas conduit (12) comprises, in addition to the inlet baffle (101), a first plurality of baffles (102) that define at least a first group of transversely arranged staggered baffles (102). These baffles (102) are substantially aligned along an axis (E1) substantially transverse to the longitudinal passage of the coolant fluid and have a staggered configuration, such that each baffle (102) is located at a different distance from the second edge (22) or end of the gas conduits (12) closest to the gas inlet (13). For example, the furthest baffle (102) of the group may be located at a distance from the second edge (22) or end of the gas conduits (12) of between 12 mm and 110 mm (measured from the center of each baffle to a safety strip 0.5 mm from the second edge (22) or end of the gas conduits (12) adjacent to the gas inlet).

A longitudinal separation (d2) is provided between said baffles (102), designed so that a baffle (102) gets closer and closer to the second edge (22) or end of the gas conduit (12) adjacent to the gas inlet, thereby defining a coolant flow distribution along the entire extent of said second edge (22) or end of the gas conduits (12).

Each baffle (102) of the first transverse group has a length of between 1 mm and 9 mm and is arranged with respect to another baffle (101) with a transverse separation (d1) between said baffles (102), with the aim of occupying the maximum width of the gas conduit (12) and being able to distribute the coolant over the entire width indicated.

Each of the baffles (102) of the first transverse group has a longitudinal axis that is arranged so as to form an angle (A1) of inclination of between 0° and 60° with respect to a longitudinal axis (E2) of the gas conduits (12).

Moreover, the present embodiment of the heat exchanger (10) comprises a baffle arrangement (100) that includes, in addition to the inlet baffle (101) and the first plurality of baffles (102):

a second plurality of baffles (103) comprising two transversely distributed groups of staggered baffles (103), arranged on a first side (L1) of the central longitudinal axis (E2) of the gas conduits (12); and a third plurality of baffles (104) comprising two transversely distributed groups of staggered baffles (104) arranged on the other side of said central longitudinal axis (E2), on the second side (L2) of said central longitudinal axis (E2) of the gas conduits (12).

Each of the groups of the second and third plurality of baffles (103 and 104) have their baffles (103 and 104) arranged at different distances from the second edge (22) or end of the gas conduits (12), so that the furthest baffle (103 and 104) in each group is at a distance ranging from 12 mm to 110 mm (measurements taken from the center of the baffle (103 and 104) to a safety strip at 0.5 mm from the second edge (22) or end of the gas conduits (12) adjacent to the gas inlet).

Likewise, each baffle (103 and 104) of the second and third plurality of baffles (103 and 104) is arranged so as to maintain a transverse separation (d1) with an adjacent baffle (103 and 104).

Preferably, the longitudinal axis of each of the baffles (103 and 104) of the second and third plurality of baffles (103 and 104) is arranged so as to form an angle (A2) of inclination of between 0° and 60° with respect to a central longitudinal axis (E2) of the gas conduits (12), considering that said range can be made both positively and negatively with respect to said central axis (E2).

All the baffles (101, 102, 103 and 104) indicated in this embodiment are stamped or embossed into the plates that form the gas conduits (12), and have a height (Rh), without coming into contact with the baffles (101, 102, 103 and 104) located on the face (15) of the adjoining conduit (12), so that they form a passage of minimum width for the coolant fluid between said baffles.

The manufacture of an exchanger as defined in the previous embodiments is based on a process comprising a step of stamping or embossing the arrangement (100) of baffles for distribution of coolant in the plates that form the gas conduit (12) or alternatively in the tube that forms same.

Although reference has been made to a specific embodiment of the invention, it is obvious for a person skilled in the art that the heat exchanger for gases, in particular engine exhaust gases, with coolant distribution baffles described is susceptible to numerous variations and modifications and that all the aforementioned details can be replaced by other technically equivalent ones, without departing from the scope of protection defined by the appended claims.

The invention claimed is:

1. A heat exchanger for engine exhaust gases, comprising:

a heat-exchanger casing that delimits a circuit for the circulation of a coolant fluid;

a plurality of gas conduits installed within said heat-exchanger casing;

a gas inlet for gas circulation; and a coolant fluid inlet inside the casing, wherein the gas conduits each comprise an arrangement of baffles for distributing coolant on at least one of the outer faces thereof, said arrangement of baffles for distributing coolant comprising at least one inlet baffle-located near the coolant inlet, said inlet baffle including a first portion and a second portion arranged in a substantially orthogonal position so as to guide the coolant inlet toward the gas inlet, wherein the baffles have a height that is at most substantially equal to half the separation distance between gas conduits, among which said baffles are located, and wherein the baffles do not come into contact with baffles located in the adjoining gas conduit in an opposing manner.

2. The heat exchanger for gases as claimed in claim 1, wherein the first portion of the inlet baffle is substantially perpendicular to a plane defined by the first edge or side of the gas conduits, without obstructing the coolant inlet, wherein the second portion is substantially parallel to the same plane defined by said first edge or side of the gas conduits, and wherein the second portion is arranged facing the gas inlet.

3. The heat exchanger for gases as claimed in claim 1, wherein said first and second portion of the inlet baffle form a single "L"-shaped piece.

4. The heat exchanger for gases as claimed in claim 1, wherein an end of the second portion of the inlet baffle, which is the end not adjoining the first portion, is located at a distance of between 6 mm and 12 mm from a second edge or end of the gas conduits facing the gas inlet.

5. The heat exchanger for gases as claimed in claim 1, wherein an end of the second portion of the inlet baffle, which is the end not adjoining the first portion, is located at a distance of between 3.5 mm and 8 mm from the first edge or side of the gas conduits.

6. The heat exchanger for gases as claimed in claim 1, wherein said arrangement of coolant distribution baffles comprises, in addition to the inlet baffle, a first plurality of baffles that define at least one first group of transversely arranged baffles in a staggered configuration, such that each baffle of said first group of transversely arranged baffles is situated at a different distance from the second edge or end of the gas conduits, thereby defining a coolant flow distribution along the entire extent of the second edge or end of the gas conduits adjacent to the gas inlet.

7. The heat exchanger for gases as claimed in claim 6, wherein a longitudinal axis of each baffle of the first transversely arranged group is arranged so as to form an angle of inclination of between 0° and 60° with respect to a longitudinal axis of the gas conduits.

8. The heat exchanger for gases as claimed in claim 1, wherein said arrangement of baffles comprises, in addition to the inlet baffle, a second plurality of baffles including one or more transversely distributed groups of staggered baffles, arranged on a first side of a central longitudinal axis of the gas conduits, and a third plurality of baffles comprising one or more transversely distributed groups of staggered baffles arranged on a second side of the central longitudinal axis of the gas conduits, and wherein the one or more groups of the second and third plurality of baffles are arranged at different distances from a second edge or end of the gas conduits adjacent to the gas inlet.

9. The heat exchanger for gases as claimed in claim 8, wherein a longitudinal axis of each of the baffles of the second and third plurality of baffles is arranged so as to form an angle of inclination of between 0° and 60° with respect to a longitudinal axis of the gas conduits.

10. The heat exchanger for gases as claimed in claim 1, wherein the inlet baffle comprises at least a third portion for transition between the first portion and the second portion.

11. A process for manufacturing a heat exchanger as claimed in claim 1, comprising: stamping or embossing the arrangement of coolant distribution baffles in a gas conduit, said stamping or embossing being carried out on at least one plate or on at least one tube, forming part of said gas conduit.

12. The heat exchanger for gases as claimed in claim 1, wherein the opposing baffles come into contact with each other, preventing the passage of coolant fluid between these opposing baffles of adjoining gas conduits.

13. The heat exchanger for gases as claimed in claim 1, wherein each of the gas conduits is formed by a pair of plates or by a tube, and wherein the inlet baffle and/or the first, second and/or third plurality of baffles are obtained by stamping or embossing on at least one external face of the conduit.

14. The heat exchanger for gases as claimed in claim 1, wherein the heat exchanger is a shell-and-tube heat exchanger.

15. The heat exchanger for gases as claimed in claim 1, wherein the second portion of the inlet baffle has a length that is at least equal to or greater than the width of the opening of the coolant inlet.

* * * * *